US008490439B2

(12) United States Patent
Hill et al.

(10) Patent No.: US 8,490,439 B2
(45) Date of Patent: Jul. 23, 2013

(54) WATER RECIRCULATION AND DRUM ROTATION CONTROL IN A LAUNDRY WASHER

(75) Inventors: Chris H. Hill, Ames, IA (US); Jason D. Miller, Iowa Falls, IA (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 13/449,450

(22) Filed: Apr. 18, 2012

(65) Prior Publication Data

US 2013/0081431 A1 Apr. 4, 2013

Related U.S. Application Data

(60) Provisional application No. 61/541,881, filed on Sep. 30, 2011.

(51) Int. Cl.
*D06F 33/02* (2006.01)
*D06F 39/08* (2006.01)

(52) U.S. Cl.
USPC ..... 68/12.05; 68/12.19; 68/23.5; 68/24; 68/207

(58) Field of Classification Search
USPC ..... 68/12.02, 12.19, 12.05, 207, 23.5, 68/24, 58
See application file for complete search history.

(56) References Cited

U.S. PATENT DOCUMENTS

| | | | | |
|---|---|---|---|---|
| 3,099,022 | A | | 7/1963 | Geschka et al. |
| 3,209,560 | A | | 10/1965 | Shelton |
| 3,248,914 | A | * | 5/1966 | Tingley, Jr. ..... 68/207 |
| 3,517,143 | A | * | 6/1970 | Scheer ..... 200/38 R |
| 3,727,435 | A | | 4/1973 | Menk |
| 3,770,376 | A | | 11/1973 | Sharpe |
| 3,935,719 | A | | 2/1976 | Henderson |
| 4,000,968 | A | * | 1/1977 | Schrage et al. ..... 8/158 |
| 4,162,621 | A | | 7/1979 | Stone |
| 4,168,615 | A | | 9/1979 | Condit |
| 4,231,130 | A | * | 11/1980 | Tobita et al. ..... 8/159 |
| 4,637,231 | A | | 1/1987 | McMillan et al. |
| 4,696,171 | A | | 9/1987 | Babuin |
| 4,711,103 | A | | 12/1987 | Mori et al. |
| 4,727,733 | A | * | 3/1988 | Huber ..... 68/12.15 |
| 4,779,430 | A | * | 10/1988 | Thuruta et al. ..... 68/12.04 |

(Continued)

FOREIGN PATENT DOCUMENTS

| | | | |
|---|---|---|---|
| CN | 101851839 | * | 10/2012 |
| DE | 31 41 791 | * | 7/1989 |

(Continued)

*Primary Examiner* — Joseph L Perrin
(74) *Attorney, Agent, or Firm* — Banner & Witcoff, Ltd.

(57) ABSTRACT

In a laundry washer, relatively short bursts of operation of a recirculation pump are coordinated with corresponding brief intervals of tub rotation during the initial fill periods. The aim is to thoroughly wet the clothes early in each wash/rinse phase to thus improve the wash/rinse effectiveness, while also avoiding excessive suds formation. Following the initial fill periods and during regular wash/rinse agitations, the recirculation system may also be employed to "recharge" the laundry load with detergent that has settled in the bottom of the tub. In a further aspect of the invention, some or all of the conventional intermediate spin extractions are omitted. In this manner, more water is carried over in the clothes from one wash/rinse cycle to the next. An intermediate spin of reduced speed (RPM) and duration as compared to typical normal intermediate spins may be employed between the wash phase and first rinse.

22 Claims, 2 Drawing Sheets

U.S. PATENT DOCUMENTS

| | | | | |
|---|---|---|---|---|
| 4,987,627 | A | 1/1991 | Cur et al. | |
| 5,038,586 | A * | 8/1991 | Nukaga et al. | 68/12.01 |
| 5,233,718 | A | 8/1993 | Hardaway et al. | |
| 5,460,018 | A | 10/1995 | Wener et al. | |
| 5,687,440 | A | 11/1997 | Min et al. | |
| 5,724,690 | A * | 3/1998 | Babuin et al. | 8/158 |
| 5,758,377 | A | 6/1998 | Cimetta et al. | |
| 5,829,275 | A | 11/1998 | Babuin et al. | |
| 5,870,905 | A | 2/1999 | Imamura et al. | |
| 6,023,950 | A | 2/2000 | Battistella | |
| 6,134,925 | A * | 10/2000 | Fujii et al. | 68/12.04 |
| 6,269,666 | B1 | 8/2001 | Whah et al. | |
| 6,402,962 | B1 | 6/2002 | Bruntz et al. | |
| 6,578,586 | B2 | 6/2003 | Moh | |
| 7,421,752 | B2 | 9/2008 | Donadon et al. | |
| 7,621,013 | B2 | 11/2009 | Jeon et al. | |
| 7,636,973 | B2 | 12/2009 | Shaffer | |
| 7,703,306 | B2 | 4/2010 | Shaffer | |
| 7,814,596 | B2 | 10/2010 | Do et al. | |
| 2004/0168482 | A1 * | 9/2004 | Lyu et al. | 68/13 R |
| 2005/0217036 | A1 * | 10/2005 | Park | 8/158 |
| 2006/0107468 | A1 | 5/2006 | Urbanet et al. | |
| 2006/0191078 | A1 | 8/2006 | Kim et al. | |
| 2007/0107138 | A1 | 5/2007 | Bernardino et al. | |
| 2008/0104770 | A1 * | 5/2008 | Hwang | 8/159 |
| 2008/0172804 | A1 | 7/2008 | Vanhazebrouck et al. | |
| 2008/0282479 | A1 | 11/2008 | Darby | |
| 2009/0100608 | A1 | 4/2009 | Lee et al. | |
| 2010/0126236 | A1 | 5/2010 | Seo et al. | |
| 2011/0099726 | A1 | 5/2011 | Plata Amarillas et al. | |
| 2011/0138543 | A1 | 6/2011 | Cavalli et al. | |
| 2012/0060301 | A1 * | 3/2012 | Kim et al. | 8/137 |

FOREIGN PATENT DOCUMENTS

| | | | |
|---|---|---|---|
| DE | 4115776 | A1 | 11/1992 |
| DE | 42 10 577 | C2 | 10/1993 |
| EP | 1 688 529 | A1 | 9/2006 |
| EP | 2 143 838 | A1 | 1/2010 |
| EP | 2 189 568 | A1 | 5/2010 |
| JP | 60-007898 | * | 1/1985 |
| JP | 2006-061433 | * | 3/2006 |
| JP | 2011-056112 | * | 3/2011 |
| WO | WO 03/010380 | * | 2/2003 |
| WO | 2007/003593 | A1 | 1/2007 |
| WO | 2008/079070 | A1 | 7/2008 |

* cited by examiner

WATER RECIRCULATION AND DRUM ROTATION CONTROL IN A LAUNDRY WASHER

CROSS-REFERENCE TO RELATED APPLICATION

The present application claims priority based on U.S. provisional application Ser. No. 61/541,881, filed Sep. 30, 2011, the contents of which is incorporated in its entirety, both bodily and by reference.

BACKGROUND

The present inventions relate to water recirculation systems in laundry washers, and particularly those suitable for use in a front load (e.g., horizontal axis) washer. Such systems may use a single outlet located on the upper side of the tub bellows for both inputting fresh water and inputting water recirculated from the bottom (sump) of the tub, or alternatively separate respective outlets may be used for these two circuits. Such a recirculation system takes wash water from the bottom of the tub and pumps it to an upper part of the rotatable drum to help wet the clothes and improve wash and rinse action.

Some models of front load washing machines in the marketplace have a recirculation pump and system that allows the water inside the wash tub to be recirculated from bottom to top. With such a system, there is a constraint in that the system should not cause a situation where the soap inside the machine suds to such a degree that the suds cannot be effectively removed from the clothes during the rinse cycle(s). On the other hand, it is desirable to get the clothes wet with detergent as early in the wash cycle as possible to maximize the wash performance of the machine. These two constraints are somewhat contradictory. The first makes it desirable to have the recirculation pump used on a limited basis. The second dictates that the recirculation pump be used as much as possible.

It is also typical in front load washing machines to have a wash phase and then an intermediate spin followed by a first rinse phase and another intermediate spin, followed by a final rinse phase. Additives such as bleach and fabric softener may or not be added during the rinses. The main function of the rinses is to remove detergent from the clothes after the wash portion of the cycle. Recirculation could be beneficial in each of these phases if it could be implemented in a manner that effectively controls excess sudsing.

In order to meet the contradictory requirements of avoiding excess suds formation, and on the other hand maximize the beneficial use of water recirculation, there is a need to increase the efficiency with which the recirculation system is used. In addition, it is desirable to reduce the amount of water consumption in the wash process without sacrificing wash performance.

BRIEF SUMMARY OF SELECTED INVENTIVE ASPECTS

A basic idea with an aspect of the present invention is that relatively short bursts of operation of the recirculation pump are coordinated with corresponding brief intervals of tub rotation to maximize exposure of the clothes to the recirculated water stream early in the wash and/or rinse cycles, during the initial fill periods. The aim is to thoroughly wet the clothes early in each wash/rinse phase to thus improve the wash/rinse effectiveness, while also avoiding excessive suds formation. Excess suds are difficult to remove from the clothes in the rinses, and cause other problems such as "suds lock," which imposes excessive friction drag on the rotatable drum's drive motor. Following the initial fill periods and during regular wash/rinse agitations, the recirculation system may also be employed to "recharge" the laundry load with detergent that has settled in the bottom of the tub.

In an aspect, an objective of the present invention is to maximize the effectiveness of the front load washer recirculation system by coordinating the tub movement with the intermittent brief activations or "bursts" of the recirculation system during an initial fill portion of one or more of the wash and rinse phases of the overall washer operation cycle.

A second aspect relates to the spin extractions that are typically provided between successive wash and/or rinse cycles. During these conventional intermediate spin extractions, high speed drum rotations plaster the clothes against the walls of the tub and water is extracted from the clothes by the centrifugal force. According to an aspect of the invention, some or all of the conventional intermediate spin extractions are omitted. In this manner, more water is carried over in the clothes from one wash/rinse cycle to the next. Thus, the fresh water required for the subsequent cycle is reduced. The water saved allows additional fresh water to be used in the wash phase and/or final rinse phase while staying within a given overall water consumption budget.

Such a process can work effectively in conjunction with the recirculation aspects described, to get better wash performance without causing excessive suds, and to remove the suds from the clothes more efficiently. With more water carried over in the clothes to the subsequent rinse phase, not only is water conserved but the time it takes for the water in the tub to reach the minimum level required for operation of the recirculation pump can be reduced, hence allowing beneficial recirculation to start earlier.

In a related further aspect of the invention, a modified intermediate spin is employed between the wash phase and first rinse in such a manner that dirty water can be more effectively removed from the clothes and more fresh water can be added to the first rinse with the result of improved wash performance. The modified intermediate spin is preferably of reduced speed (RPM) and duration as compared to typical normal intermediate spins, and preferably only one is provided—between the wash phase and the first rinse, with all other intermediate spins being eliminated. The modified intermediate spin, preferably employed only between the wash and the first rinse, can help remove dirty water and soap residue while still allowing a significant reduction in the amount of extracted water so as to still significantly reduce total water usage. Also, as mentioned, with more water carryover and less water to replace in the next phase, beneficial recirculation may be started at an earlier stage.

In yet a further aspect, this disclosure describes an improvement relating to use of the recirculation system after the initial fill and during one or more of the wash/rinse agitation phases. During these periods, the recirculation pump may be intermittently activated for a limited number of intervals (e.g., of 30 sec—which is significantly longer than the short bursts provided during the initial fill). If during this time the water level drops below a certain amount (e.g., due to additional water being absorbed by the clothes), then fresh water is admitted to raise the level and during this time the drum rotation is stopped to allow the level (pressure) sensor to get a better reading. In order to compensate for the fact that the recirculation is not as effective in wetting the clothes without the simultaneous drum rotation, the control (e.g., software/firmware) senses when this situation occurs and in response adds an interval (e.g., of 15 seconds) of agitation and tumble following completion of the current refill step, with the recirculation pump activated.

BRIEF DESCRIPTION OF THE DRAWINGS

Aspects of the invention are illustrated by way of example and not by limitation in the accompanying figures in which like reference numerals indicate similar elements and in which.

DETAILED DESCRIPTION OF EXEMPLARY EMBODIMENTS

Figure 1:
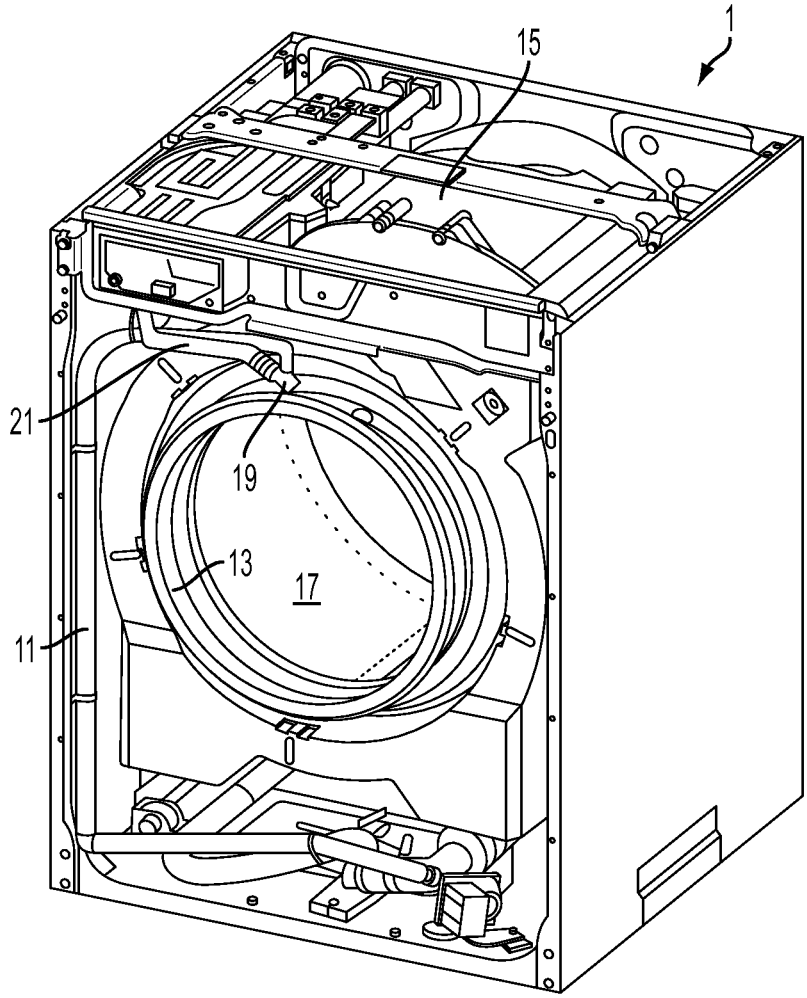
FIG. 1 is a perspective view of a front load laundry washer, including a recirculation system, to which the present inventions may be applied; the front and top panels are omitted to expose interior components.
Figure 2:
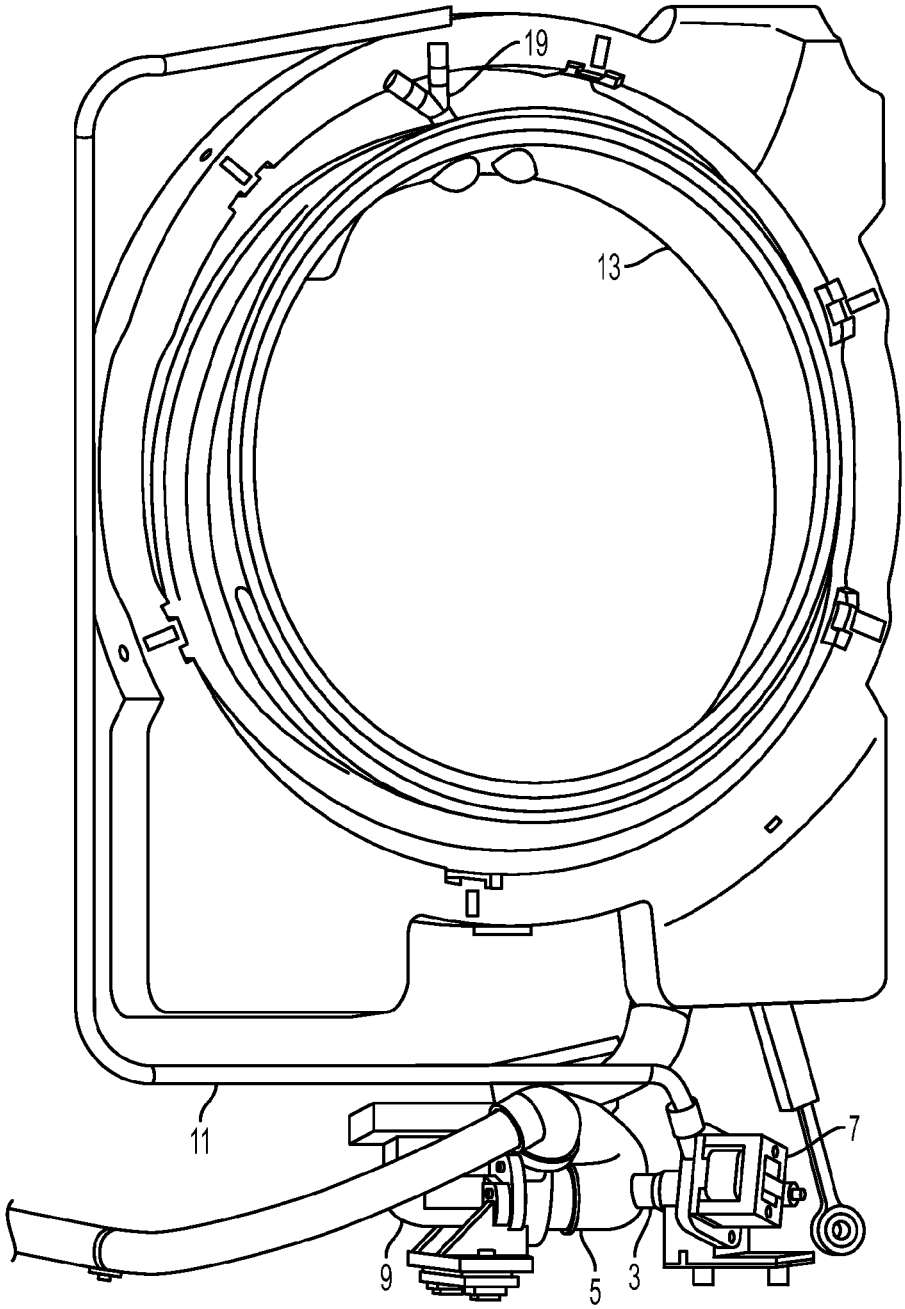
FIG. 2 is a perspective view of portions of a washer including a recirculation system, similar to the one shown in FIG. 1.

In an example embodiment, the inventive arrangements and processes are implemented as part of a front-load, horizontal axis washing machine 1 as shown in FIG. 1, including a water recirculation system. As best seen in FIG. 2, the mechanical portion of the recirculation system includes an additional outlet 3 on the existing drain 5 connected to a recirculation pump hose that is attached at its other end to the inlet of a recirculation pump 7. The recirculation pump 7 (which as shown is separate from the main drain pump 9 may be selectively energized from the main electronic board, i.e., under the control of an electronic controller. The controller may be provided as an integral part of a control panel of the washer. Such a controller may comprise a suitably programmed microprocessor or application specific integrated circuit (ASIC), operably connected to suitable circuitry for driving the recirculation pump and various other components of the washer in accordance with commands of the controller.

In the illustrated embodiment, the recirculation pump 7 creates flow out of the pump outlet that enters a hose 11 that extends upwards in the vertical direction as well as the horizontal. The hose 11 then travels along the inside front corner of the washing machine and then extends to a location at the top of the flexible bellows 13. As is generally known, the bellows 13 provides a sealed passage through the access opening of the front panel of the washer cabinet into the wash tub 15 and rotatable drum 17 therein. The recirculation hose 11 may attach to a Y-connector 19 (shown detached in FIG. 2) that has another inlet for attachment of another hose 21 that selectively delivers fresh water to the top of the tub and drum. Such fresh water delivery may be selectively carried out as part of a known "Active Rinse Technology" (ART) system/process. The connector 19 has an outlet that attaches to the bellows 13; the outlet has a port that allows water to flow into the drum and which directs that water on top of the clothes. In one embodiment, the outlet through which water is dispensed into the drum has a simple circular shape, e.g., with a diameter of 11.5 mm. The outlet is positioned and oriented to spray the water into a central region of the tub downwardly and rearwardly, e.g., at an angle of 20 degrees from the horizontal, so as to wet the clothes effectively as they drop from the top of the drum to the bottom with drum rotations that promote such action. In other contemplated embodiments, outlet nozzles of various shapes and sizes may be used to optimize the discharge (e.g. spray pattern) of water in a manner most effective for wetting the clothes in the drum rapidly and thoroughly.

As opposed to traditional soaking in a bath, the recirculation system illustrated puts water and additives (e.g., detergent, bleach, fabric softener) directly onto the clothes from the top. In a known manner, washing machine additives diluted by a flow of fresh water enter the tub 15 in the back part thereof and then flow down to a bottom part of the tub called the sump, which may comprise a recessed area on the bottom of the wash tub. Connected to the tub in the sump is a hose and filter cup that fluidly connects the tub to the drain 5. The filter cup may be a separate plastic part contained within a rubber tub-to-pump hose.

Like the drainage outlet on the tub, the inlet port of the recirculation pump is preferably positioned as low as possible. This will allow more of the water and settled detergent in the machine (including the drain plumbing) to be recirculated. The water that is in the tub is mixed as the tub is rotated. However, the water in the sump can remain effectively motionless, thus performing no useful function. By providing both the drainage outlet and the recirculation pump inlet port at low points, more of the water/wash solution may recirculate back onto the clothes.

The recirculation pump flow rate is preferably chosen to decrease fill time. Fresh water comes into the machine at a given flow rate determined by the design of the water valve and line pressure. Water rises in the tub until it hits a predetermined full level. The water then soaks into the clothes and decreases the water level. When the water level hits a predetermined low level, the water valve is energized to fill the tub with more water to the full level. By choosing a recirculation pump that creates a larger flow rate than the water being added to wash, it is possible to take water from the sump and put it directly onto the clothes faster (greater flow rate) than the water valve can fill the machine. This can allow a continuous fill until the clothes are saturated, as opposed to requiring not just an initial fill but also one or more supplemental fills to bring the water back up to full as additional water is later absorbed into the clothes (flow occurs based on the pressure sensor switching conditions).

The hose 11 from the recirculation pump 7 to the outlet at the bellows 13 may be inclined upward to decrease cavitation and noise. If a hose comes from the pump at a horizontal or angle pointing down water will drain from the pump and could cause cavitation and noise when the pump is energized. The hose in the illustrated system of FIG. 2 is inclined upward adjacent pump 7 to prevent cavitation and decrease noise.

Use of a smooth hose is desirable to prevent suds generation and reduce noise. Water mixed with detergent is more likely to cause suds if the water is flowing in a turbulent manner. Thus, preferably the hose 11 employed is a smooth hose that will promote laminar flow and thereby decrease suds generation. A smooth hose also reduces water turbulence which can lead to water flow noise.

A rigid smooth hose would require additional attachment points and clamps and the potential for leaking in the assembled state increases as the number of clamps and attachment points increases. Using a smooth flexible hose allows the hose to be attached directly to the pump 7 and Y-connector 19 resulting in only one connection point on each end of the hose. This could also be accomplished by using a rigid hose with flexible ends.

During the initial fill and after the detergent or other additive has been carried by the water into the tub, fresh water continues to enter the system through the same path as the additives mixture, as well as through the ART system previously described. The ART system may be used selectively for inputting fresh water through the same outlet used for the water circulation, e.g., during the wash phase fill and the second rinse phase fill. The water level continues to rise to a specified level (corresponding to a specified pressure sensor reading) that allows the clothes to soak up the additives and water. The recirculation system can activated according to its control scheme to recirculate water through the outlet of connector 19 while fresh water is also being dispensed from the same outlet by the ART system.

Using a wash water recirculation system as described, it is possible take the water and additives mixture from the sump and put it directly on top of the clothes, rather than simply have the clothes soak in the additives solution. The effectiveness of the detergent can be maximized by moving detergent/water solution sitting in the sump back rapidly into the clothes. Doing this earlier in the cycle increases the effectiveness of the detergent. The same is true for bleach and fabric softener. Clothes can be made cleaner and whiter, feel softer and smell better, by virtue of the recirculation.

In addition, when powdered additives are used (e.g., detergent, oxygen bleach), it is desired to dissolve those and disperse them through the clothes quickly. They may only partially dissolve when flushed from the dispenser. Recirculation can effectively advance these processes. Relatedly, it is desired to evenly disperse additive (dissolved powder or liquid) throughout the clothing quickly. On initial fill, the clothing must first be thoroughly wetted with inlet water to allow even and complete additive dispersion. Recirculation assists in this regard as well.

The recirculation timing profile can be configured to maximize the additives effectiveness while reducing potential cross-contamination of dirty water. In one embodiment, the system operates only during the initial phases of each additive step, when the additives are at their most effective state, and then turns off to ensure laundry residue is left in the sump to be drained out at the end of each additive phase.

In order to be as efficient as possible with water usage, water is added through the back entrance of the tub and the ART hose until a pressure switch is activated when the water achieves a level predetermined to be full. The clothes are then agitated by the tub rotations in order to facilitate absorption of water into the laundry. The water level then begins to drop due to water absorption and if it drops below a predetermined refill level additional fresh water is put into the washing machine to again achieve the full level. The goal is to rapidly reach a stable full water level with the clothes fully water saturated.

By putting water directly onto the clothes from the top, the recirculation system can increase the rate at which the clothes become saturated, much more so than with the ART system alone, since the flow rate is higher with recirculation due to the impact of the recirculation pump. For example, the pump may be one rated at 20 liters/min at 1 meter height, which greatly increases the flow rates over the ART system alone. This increase in the clothes saturation rate means the final goal of a full water level with saturated clothes will be reached in a shorter period of time. This allows the additives to work throughout the laundry load during the period that the additives are most effective.

By saturating the clothes faster, the recirculation system also reduces clothes damage. In existing wash processes, in order to increase the saturation time for clothes, they are agitated in the drum before they are fully saturated. This agitation can cause damage due to dry laundry rubbing on the typical rubber door gaskets, etc., which can cause friction damage to delicate fabrics. Through utilization of a recirculation system the clothes may be saturated faster during the agitation period, thus reducing damage.

Increasing the saturation of the clothes through use of recirculation as described can also improve washing performance. The major portion of added fresh water enters the drum through the back entrance to the tub and comes up from the bottom of the clothes and is soaked into the clothes. The clothes reach a maximum saturation rate based on the height of the water in the drum. In contrast, the recirculation system saturation rate is not restricted by the water height in the drum because water can be put on top of the clothes once a minimal water level has been reached. Placing water mixed with additives inside the laundry load, by way of recirculation to an outlet that sprays or otherwise dispenses the water directly onto the clothes reduces the laundry cross-section the mixture has to travel to reach all areas of the laundry load.

Recirculation as described also allows a lower water level to achieve washing performance and thus decreases water usage. Absent recirculation, in order to increase water saturation in the clothes, the water level must be increased. The recirculation system allows the saturation rate to be increased for a given water height and, therefore, the water level can be decreased and still achieve a saturation rate comparable to that of the higher water level. Use of a lower water level translates to use of less water for the wash.

A flow of water directly onto the clothes also can remove detergent more efficiently in the rinses. As background, a complete washing cycle generally comprises three main parts or phases. There is the wash phase in which detergent is mixed with the water and clothes to remove the dirt from the clothes. There is a first rinse phase during which bleach may be added to further remove dirt from the clothes as well as begin to rinse detergent from the clothes. There is a second rinse during which fabric softener may be added to soften and add a fragrance to the wash load while continuing to rinse detergent from the same. The water levels used in the first and second rinses are typically higher than during the wash phase, in order to get the detergent out of the clothes. By putting water onto the clothes directly during the rinses, the recirculation is able to get detergent out of the clothes more efficiently, so a lower water level can be used decreasing overall water usage. Placing clean water directly onto and inside the laundry load reduces the laundry cross-section the mixture has to travel to reach all areas of the laundry load to draw out residual detergent.

The recirculation can increase washing performance due to detergent being more active when soaked into the clothes. Detergent is activated by mixing with water. It is most active in the first 7 minutes after being mixed with water. The activity decreases as time passes. Clothes are cleaned by soaking in active detergent. The recirculation system gets more detergent into the clothes sooner when the detergent is more active.

Recirculation can decrease cycle time because clothes are saturated with detergent faster. When detergent is soaked into the clothes the detergent infuses with the dirt and then both are removed during later rinses. In order to facilitate this action the clothes are agitated (by horizontal tub rotations in a horizontal axis machine). The longer saturated clothes are agitated the more dirt that can be removed. The recirculation system allows the clothes to be saturated sooner and the saturated agitation time to be increased without increasing overall cycle time. This could also be used to create a shorter overall cycle time if the same saturated agitation time as a normal cycle is used.

With recirculation, detergent can be beneficially put back onto the clothes several times throughout a given phase of the cycle. In the wash phase, for example, water and detergent are mixed with the clothes as they are agitated. As the phase continues, the detergent can settle in the bottom of the sump. The recirculation system can be activated intermittently throughout the wash phase, or a portion thereof, to re-charge the laundry load with more detergent that has settled at the bottom of the sump while reducing cross-contamination due to recirculation of dirty water back onto the clothes, and also reducing sudsing.

The recirculation can increase the concentration of fabric softener and bleach during rinses. In a typical wash method, 5.3 gallons of water are mixed with the bleach and fabric softener in order to soak in enough to effectively rinse the detergent from the clothes. The recirculation system uses less water to effectively rinse the detergent from the clothes so less water can be mixed with the fabric softener and bleach resulting in a higher concentration, which can increase effectiveness of those additives and/or allow the consumer to use less additive.

A potential issue with use of a recirculation system in a front load washing machine, as described, is the creation of suds when the recirculation pump is activated. Cycling the recirculation pump on and off decreases the potential for excess suds generation.

An earlier approach to combat sudsing as a result of recirculation involved a control program that cycled the pump on at the beginning of the wash phase for a set time period of 30 seconds to assist in clothes saturation and then powered-off the recirculation for a set period of 2 minutes to minimize suds creation. This process was initiated upon a certain minimum water level being attained during the initial fill, and continued for the indicated preset time periods (typically more than one iteration). The control then energized the pump periodically through the early portion of the remainder of the wash phase to put more detergent and water on top of the laundry, but not cause oversudsing by remaining on during the entire phase.

In the previous system, control logic/software was used, during the drain portion of the wash phase, to identify an oversuds condition and in that case the recirculation pump was not energized. When a consumer uses too much detergent or the incorrect type of detergent in front load washing machine, suds can build up. This build-up can fill the entire volume of the front load washing machine. This can cause the pressure inside the machine to rise slightly which may be identified by a pressure switch/sensor.

When the pressure switch/sensor saw this unexpected rise in pressure, the control no longer activated the recirculation pump, to keep the pump from creating more suds. By saturating the clothes earlier due to recirculation, the need for supplemental (adaptive) fills subsequent to the initial fill was eliminated or reduced, and this too helped prevent excess suds formation, as explained below.

As clothes become saturated, the water level in the washing machine decreases. As it reaches a predetermined refill level, the system will energize the water valves and let more water into the machine. As the detergent mixes with the water it can cause suds. As suds increase to an unacceptably high level, the sudsing will cause the water level to drop. The pressure switch/sensor will sense this and the control will ask for more water which will result in more suds causing an increasing cycle of additional suds and additional water.

Typical washer functionality is to fill the tub with water for a target fill height $F_2$. As the washer fills from the initial fill level of $F_0$ the clothes soak up the water. When the washer fill height hits $F_2$ the washer will stop filling. Water in the tub will soak into the clothes as they are tumbling or agitating. As the clothes soak up water the water height will decrease. When the water level drops below a level $F_1$ the washing machine will start filling the tub again.

As the tub fills with water, the level will increase from $F_1$ to $F_2$. When the water level reaches $F_2$ the water flow into the tub will stop. And the clothes will continue to tumble or agitate while soaking up the water in the tub. The process of refilling will continue for several minutes while the clothes gradually soak up water.

Typically, the washer cycle time is determined by a program which dictates the wash time as a fixed amount. If the clothes are saturated quickly they will have a long period of saturated agitation and washing. However, if the clothes take longer to become saturated they will have a shorter period of time in which to agitate and wash in the saturated condition. This creates a desire to have the clothes become saturated as fast as possible. The previous system just described accomplished this goal in large measure. However, room remained for further reduction of the sudsing conditions that could arise as a result of the recirculations, and for shortening even further the time required to achieve full saturation of the load. Aspects of the present invention address these issues.

The inventive process described below is designed to help the clothes become saturated as fast as possible by coordinating the agitation and recirculation pump operations in such a way as to provide the benefit of rapid saturation, and with even less tendency for excessive suds development.

In an exemplary embodiment, there is a desired final fill height in the tub $L_4$. The initial water height in the tub is $L_0$. The software will activate the water valves allowing water into the drum in order to fill the tub for the wash phase. The drum will begin to rotate or agitate at an RPM A, e.g., a typical agitation tumble speed in the range of 48-52 rpm.

As the water fills it will reach a point $L_1$ at which the recirculation pump will be activated. The lower $L_1$ is, the sooner the recirculation pump will be activated. Also, the sooner the recirculation pump is activated, the greater the concentration of soap in the water will be because all of the detergent should be in the tub, while just a portion of the total water is in the tub. As the water continues to fill, the concentration of the soap to water will decrease.

When the recirculation pump is activated, the drum rotation will change to agitate at an RPM of B lower than A, e.g., 30 rpm, set to maximize the time the clothes will spend in front of the recirculation outlet to be impacted by the water stream/spray. With a recirculation outlet as shown and described, this can be accomplished by setting the rotation speed such that the load items tumble down from the top half of the drum, e.g., from the 10-12 o'clock position. If the drum speed is too fast, the clothes will rotate against the cylindrical drum wall right over the top of the stream of water from the recirculation hose outlet. If the drum speed is too slow, the clothes may tumble in the lower half of the drum and thus the recirculated water may go right over the top of the clothes not saturating them as efficiently as possible.

In accordance with an aspect of the invention, to avoid a situation of excessive suds formation, the recirculation pump will only be allowed to operate for intervals of X seconds (e.g., X=6), between which the recirculation pump will be deactivated and the clothes tumbling/drum rotation will also cease. The action of the clothes tumbling can also cause suds to form. The water will continue to fill during this pause in recirculation and tumbling. The pressure sensor/switch will take continuous readings corresponding to water height. However, when the recirculation and tumbling are not happening, the water level will be the least agitated and the most precise level sensing can be carried out.

After a pause or dwell in the recirculation pump activation and tumbling of Y seconds (e.g., Y=10), the pump will again be activated and the tumbling will be resumed in concert. This pattern of recirculation and drum activation for X seconds and then pausing for Y seconds will continue with the water filling the entire time until the water height reaches $L_3$. Thus, in accordance with the present inventive aspect, the period of intermittent recirculation (and coordinated drum rotation) is delimited as a function of the time it takes to reach a certain water level, rather than a preset time interval. In addition, employing short bursts of recirculation during the fill beneficially allows the recirculation to begin earlier, upon reaching a lower minimum water level than would be required for longer intervals of pump operation.

When the water fill height reaches $L_3$ the recirculation pump and drum preferably remain motionless as the water fills to the final fill target of $L_4$. This will allow the more precise water level reading due to the relatively still water level. As mentioned, while the recirculation pump and drum are activated, the water level has large variations due to the motion of the drum and water.

Once the water level reaches a target height of $L_4$, the machine may return to conventional functionality to perform agitation while continuously monitoring water height, and adding water to the wash as normal while spinning at the RPM A (48-52 rpm) that maximizes washability. In accordance with an aspect of the present invention, the control may be set to not allow additional fresh water into the machine after a predetermined time by which the clothes will be saturated. This is made possible due to the efficiency with which the recirculation system saturates the clothes.

In order to further provide the ability to perform the above functionality, it is desirable to have a higher fill level in the wash portion of the cycle without using more overall water. Previously, this would have been accomplished by removing water from the rinse portions of the cycle. However, at some point the rinse portion is operating at the lowest level possible.

In accordance with a further inventive aspect, by removing the intermediate spin extractions and allowing the clothes to carry water from one portion of the cycle over to the next, less water will be required for each rinse and this water can then be redistributed to other phases. Some of that water could be used to increase the ability to get water into the clothes at the beginning of the cycle, while some of that water can be put back into the final rinse to keep rinse performance satisfactory.

Neither of these base concepts (regarding recirculation on one hand and removal of intermediate spins on the other) necessarily requires the other for functionality. For example, the intermediate spins could be removed from a washing machine without a recirculation system as described. The concept would still work and provide benefit. However, the benefit may not be as great as when the concept is used in conjunction with the described recirculation system. The combination is especially beneficial since the added water carry-over achieved by eliminating the intermediate spins reduces the time before a minimal water level is achieved in the next phase at which the recirculation pump may be started. By starting the pump earlier, the clothes may be fully saturated more quickly, with the attendant advantages previously described.

While coordination of the tub rotations with periods of recirculation, as described, is deemed particularly beneficial, it is also contemplated that the recirculation pump operations (e.g., on-and-off pattern) could be carried out without the simultaneous tub rotations/agitations. Conversely, the agitation patterns described could be implemented without recirculation, or with a different recirculation scheme.

A modified approach with the potential to improve wash performance while still reducing water consumption involves introduction of one intermediate spin after the initial wash and before the first rinse. The modified intermediate spin would preferably be a spin of relatively short duration and low speed. The spin would use centripetal force to remove suds and dirty water from the clothes following the wash phase (and preferably only then). Because the amount of water in the clothes would be decreased, these clothes would be more likely to accept a greater amount of fresh clean water during the initial rinse—the rinse most critical for removal of dirt and residual detergent from the clothes. At the same time, due to the fact that the spin duration and rotation speed (e.g., 30 seconds and 450 rpm) are reduced from ordinary intermediate spin extraction levels (e.g., a total of 1 minute of spin, with 30 seconds at 500 rpm and 30 seconds at 650 rpm), and the other intermediate spins are eliminated, the water savings and other benefits previously described can still be achieved to a significant degree.

In an exemplary embodiment, the wash portion of the overall wash operation cycle employs the described "bursts" of recirculation and complimentary tub rotation during the initial fill of the wash phase. After the initial fill, the clothes continue to tumble while the recirculation system pauses for a period (e.g., 2 minutes) and then activates for an interval of longer duration than used during the fill (e.g., 30 seconds). The rotational speed may be reduced to 30 rpm during these 30 second agitations as well, to get the clothes in front of the spray as is done during the earlier "bursts." This pattern may be repeated a predetermined number of times (e.g., 4 times) and then the recirculation pump is not activated again until the rinse portion of the cycle (when the recirculation/tub rotation pattern may repeat, or a similar pattern may be employed).

During this portion of the wash cycle, the water level is monitored and if the water level drops below a pre-defined refill level the unit will stop tumbling and the water valve will be activated allowing more water into the tub. This allows the water level to be stable while the pressure sensor/switch monitors the water height. During these periods the benefit of simultaneous tumbling and recirculation pump activation in facilitating the injection of water into the clothes are not obtained.

On smaller loads, the initial fill employing the described intermittent recirculation and coordinated tub rotations ought to inject enough water into the clothes such that no refills are called for during the main wash. On larger loads, however, refills are likely to occur. The larger the load, the greater the chance for a greater number of refills.

If the recirculation pump is activated and during the 30 second recirculation phase the clothes stop tumbling to permit a refill, then with the recirculation system continuing to operate it would dump water on top of the clothes in a limited area. This reduces the effectiveness of the recirculation to inject the water and detergent solution into the clothes. A still further aspect of the invention addresses this situation.

In an embodiment, the control logic identifies the interruption of tumbling with the recirculation for refill purposes and in response adds an interval (e.g., 15 seconds) of agitation and tumble with recirculation to compensate. This may occur immediately after the completion of the current refill step.

For larger loads where this can occur more frequently, this added interval can occur more often. For smaller loads or other conditions when no interruptions of tumble with recirculation are required for refill purposes, there will be no intervals (e.g., 15 seconds) of agitation and recirculation added. The addition of the 15 seconds or so of agitation and tumbling along with water circulation will, for larger loads, facilitate the dampening of the clothes by injecting water into the clothes while they are moving, without risking creating too many suds in the case of small loads.

The invention has been described in terms of particular exemplary embodiments. Numerous other embodiments, modifications and variations within the scope and spirit of the invention as defined in the appended claims will occur to persons of ordinary skill in the art from a review of this disclosure.

The invention claimed is:

1. A front-load automatic laundry washer comprising:

a cabinet;

a tub within said cabinet;

a rotatable drum within said tub;

a drive motor operably connected to said drum to drive rotation of said drum;

a water supply system for supplying fresh water into said tub and drum;

a water drain system for draining water from said tub and drum;

a water recirculation system for recirculating water from a lower portion of said tub to an upper portion of said tub, said water circulation system comprising a pump; and a controller, said controller controlling said water supply system, said recirculation system including said pump, and said drive motor to provide a period of intermittent intervals of water recirculation in coordination with corresponding intervals of rotation of said drum at a tumble speed that results in wash load items placed within said drum tumbling within the drum to be impacted by recirculated water entering at said upper portion of the tub, said controlling being carried out during a supply of fresh water into the tub by said water supply system in an initial fill period.

2. An automatic laundry washer according to claim 1, wherein said controller further controls said recirculation system and said drive motor to provide further intervals of water recirculation coordinated with corresponding further intervals of drum rotation, following said initial fill period and during a wash or rinse phase of operation of the washer, said further intervals water recirculation and drum rotation being of longer duration than said intermittent intervals of water recirculation and drum rotation during the initial fill period.

3. An automatic laundry washer according to claim 2, wherein said corresponding further intervals of rotation of said drum are carried out at a rotation speed which is less than an agitation tumble speed at which the drum is otherwise rotated during said wash or rinse phase.

4. An automatic laundry washer according to claim 1, wherein said intermittent intervals are of a set duration.

5. An automatic laundry washer according to claim 1, wherein said intermittent intervals of water recirculation are each less than 30 seconds in duration.

6. An automatic laundry washer according to claim 5, wherein said intermittent intervals of water recirculation are approximately 6 seconds long.

7. An automatic laundry washer according to claim 6, wherein said intervals of water recirculation and drum rotation are separated by dwell periods of set duration during which no recirculation or drum rotation occurs.

8. An automatic laundry washer according to claim 7, wherein the set duration of the dwell periods is approximately 10 seconds.

9. An automatic laundry washer according to claim 1, wherein the period of intermittent intervals is delimited as a function of the time it takes to reach a detected water level within the tub.

10. An automatic laundry washer according to claim 9, wherein said controller controls said water supply system, said recirculation system and said drive motor to carry out a washing cycle comprising a wash phase, a first rinse phase and a second rinse phase, and wherein said second rinse phase follows said first rinse phase without any intermediate spin phase occurring between said first rinse phase and said second rinse phase.

11. An automatic laundry washer according to claim 10, wherein said controller controls said drive motor to provide an intermediate spin of the tub between the wash phase and the first rinse phase.

12. An automatic laundry washer according to claim 9, wherein said controller controls said water supply system to continue to supply water to the tub following termination of the period of intermittent intervals, until a final target fill level is reached.

13. An automatic laundry washer according to claim 1, wherein an outlet is provided for inputting fresh water to the upper portion of the tub.

14. An automatic laundry washer according to claim 13, wherein said outlet also inputs water recirculated from the lower portion of the tub.

15. An automatic laundry washer according to claim 13, said water recirculation system comprising a pump providing a water recirculation flow rate exceeding a flow rate of fresh water provided by said water supply system to the upper portion of said tub.

16. An automatic laundry washer according to claim 1, wherein said corresponding intervals of rotation of said drum are carried out at a rotation speed which is less than an agitation tumble speed at which the drum is rotated prior to and after said period of intermittent intervals.

17. An automatic laundry washer according to claim 1, wherein said period of intermittent intervals is initiated upon detecting that a first water level in the tub has been reached.

18. An automatic laundry washer comprising:

a cabinet;

a tub within said cabinet;

a rotatable drum within said tub;

a drive motor operably connected to said drum to drive rotation of said drum;

a water supply system for supplying fresh water into said tub and drum;

a water drain system for draining water from said tub and drum;

a water recirculation system for recirculating water from a lower ion of said tub to an upper portion of said tub; and a controller, said controller controlling said water supply system, said recirculation system and said drive motor to provide a period of intermittent intervals of water recirculation in coordination with corresponding intervals of rotation of said drum, during a supply of fresh water into the tub by said water supply system in an initial fill period, wherein said period of intermittent intervals is initiated upon detecting that a first water level in the tub has been reached and said period of intermittent intervals is terminated upon the controller detecting that a second water level in the tub has been reached, above said first water level.

19. An automatic laundry washer according to claim 18, wherein said controller controls said water supply system to continue to supply water to the tub following termination of the period of intermittent intervals, until a final target fill level is reached.

20. An automatic laundry washer according to claim 19, wherein after said final target fill level has been reached, said controller monitors water height and causes said water supply system to add water as necessary to maintain said fill level, and is set so as not to allow any additional fresh water into the tub after a predetermined time interval.

21. An automatic front load laundry washer comprising:

a cabinet;

a tub within said cabinet;

a rotatable drum within said tub;

a drive motor operably connected to said drum to drive rotation of said drum;

a water supply system for supplying fresh water into said tub and drum;

a water drain system for draining water from said tub and drum;

a water recirculation system for recirculating water from a lower portion of said tub to an upper portion of said tub; and a controller, said controller controlling said water supply system, said recirculation system and said drive motor to carry out a washing cycle comprising a wash phase and a rinse phase, and wherein in at least one of said wash phase and rinse phase said controller:

controls said recirculation system and said drive motor to provide an interval of water recirculation coordinated with a corresponding interval of drum rotation;

monitors a measure of water height in the tub and causes said water supply system to add water in a refill interval as necessary to maintain said fill level, wherein during a said refill interval an ongoing interval of drum rotation during water recirculation is halted; and determines when an ongoing interval of drum rotation during water recirculation is halted during a said refill interval, and in that case adds an interval of water recirculation and corresponding interval of drum rotation following said refill interval.

22. An automatic front load laundry washer according to claim 21, wherein the added interval of water recirculation and corresponding interval of drum rotation following said refill interval is of a set duration.

* * * * *

UNITED STATES PATENT AND TRADEMARK OFFICE

CERTIFICATE OF CORRECTION

PATENT NO. : 8,490,439 B2
APPLICATION NO. : 13/449450
DATED : July 23, 2013
INVENTOR(S) : Chris H. Hill et al.

It is certified that error appears in the above-identified patent and that said Letters Patent is hereby corrected as shown below:

In the Claims

Column 12, Claim 18, Line 46:
Please delete "lower ion" and insert -- lower portion --

Signed and Sealed this
Fifteenth Day of December, 2015

Michelle K. Lee

Michelle K. Lee
*Director of the United States Patent and Trademark Office*